United States Patent [19]

DeVogelaere

[11] 3,982,761

[45] Sept. 28, 1976

[54] CANTILEVERED PELLET BACKSTOP

[76] Inventor: George E. DeVogelaere, 594 Landing Road North, Rochester, N.Y. 14625

[22] Filed: Mar. 17, 1975

[21] Appl. No.: 559,324

[52] U.S. Cl. ..... 273/102.4; 73/167; 273/102 S

[51] Int. Cl.[2] ..... F41J 1/12

[58] Field of Search ..... 40/138; 73/167; 273/102.4, 105.2, 105.6

[56] References Cited

UNITED STATES PATENTS

| | | | |
|---|---|---|---|
| 2,397,921 | 4/1946 | Cole | 273/102.4 |
| 2,838,309 | 6/1958 | Merz | 273/102.4 |
| 3,319,960 | 5/1967 | Wilcox | 273/102.4 |
| 3,477,724 | 11/1969 | Wilcox | 273/102.4 |
| 3,495,829 | 2/1970 | Booth | 273/102.4 |

*Primary Examiner*—Richard C. Pinkham
*Assistant Examiner*—Marvin Siskind
*Attorney, Agent, or Firm*—Schovee & Boston

[57] ABSTRACT

The disclosure is directed to a novel range for receiving lead pellets from 0.177 up to 0.22-calibre and weighing from 7 to 16 grains fired from spring, gas (CO2) and pump style air powered guns at velocities of up to 800 feet per second. A preferred embodiment of the range comprises an 18Ga base and a somewhat resilient 16ga backstop attached to the base with only two bolts. The two-bolt, two-piece construction allows the backstop, when struck by a pellet, to act as a vibrating tuning fork, thus dissipating the energy of the pellet. The backstop absorbs pellet energy without destroying the metal, a problem with fixed non-movable backstops. The backstop therefore comprises thinner material which may be fixed at a greater angle of incidence to pellet paths than backstops in prior art pellet ranges.

6 Claims, 2 Drawing Figures

CANTILEVERED PELLET BACKSTOP

FIELD OF THE INVENTION

The invention relates to target ranges and more particularly to gas and air powered pellet gun ranges.

BACKGROUND OF THE INVENTION

Most prior art pellet gun ranges comprise comparatively heavy steel backstops which, with use, develop hammered out areas. This happens because the backstops are rigidly secured to bases so that they do not vibrate, flex or otherwise move to absorb energy when struck by a pellet. Even the best commercially available ranges will hammer out and develop deep dents and eventually holes from extensive use after pellets strike a small backstop region thousands of times. For example, even with 10ga steel, 5,000 to 10,000 shots into a small area will dent a typical prior art range. A 16ga backstop on a range in accordance with the invention has survived 20,000 shots into a similarly small area without any trace of denting, or even wear.

To minimize this deterioration, the National Rifle Association recommends that ranges be built with backstops that meet pellet trajectories at less than about 45°. Therefore, essentially all commercially available ranges have backstops that are about 45° or less from the horizontal, for typical essentially horizontally travelling pellets. This requirement means that such ranges must be at least as deep as they are tall and results in the bulky, heavy ranges that are presently available. The heavy steel backstop materials prior art ranges require also adds to their cost and weight.

One object of the present invention is to reduce range bulk and weight.

Another object of the invention is to increase range lifetime.

One advantage of the invention is the savings in the cost of materials over conventional prior art ranges.

Another advantage of the invention is the reduced horizontal surface required to support a range constructed in accordance with the present invention.

SUMMARY OF THE INVENTION

In accordance with the present invention, there is provided a pellet range for receiving lead pellets from gas, spring, and air powered pellet guns at up to about 800 feet per second, weighing up to about 16gr and of up to about 0.22 calibre. The range comprises a base and a resilient steel backstop for receiving pellets fired into the range and for vibrating in response to being struck by the pellets to dissipate their energy. The backstop is sufficiently thin to be damaged by the pellets if held rigid. A backstop vibration allowing mounting of the backstop to the base and resilient sidewalls allows the backstop to vibrate when struck by pellets. Because of its unique vibratory action, the backstop may be positioned at an angle of up to about 65° to the direction of pellet travel, typically the horizontal.

BRIEF OF DESCRIPTION OF THE DRAWINGS

Other objects and advantages of the present invention will be apparent to those skilled in the art from the following description, with reference to the appended drawings wherein like numbers denote like parts, and wherein:

FIG. 1 is a perspective view of a preferred embodiment of the invention; and FIG. 2 is a cutaway side view of the embodiment of FIG. 1.

DETAILED DESCRIPTION OF A PREFERRED EMBODIMENT OF THE INVENTION

Figure 2:
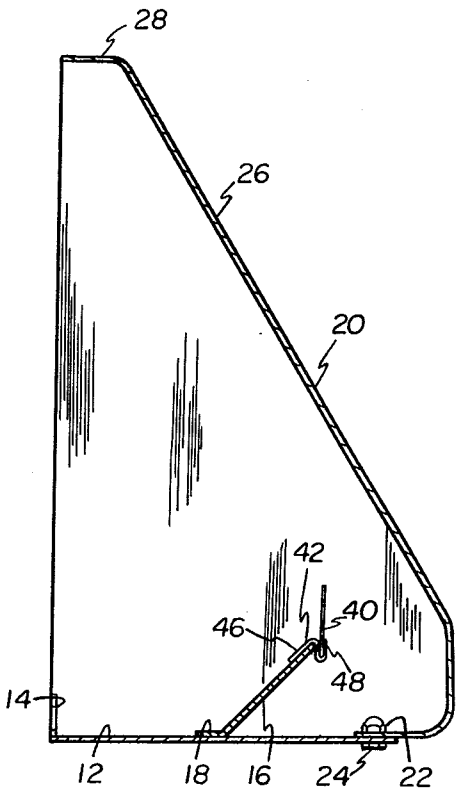
Figure 1:
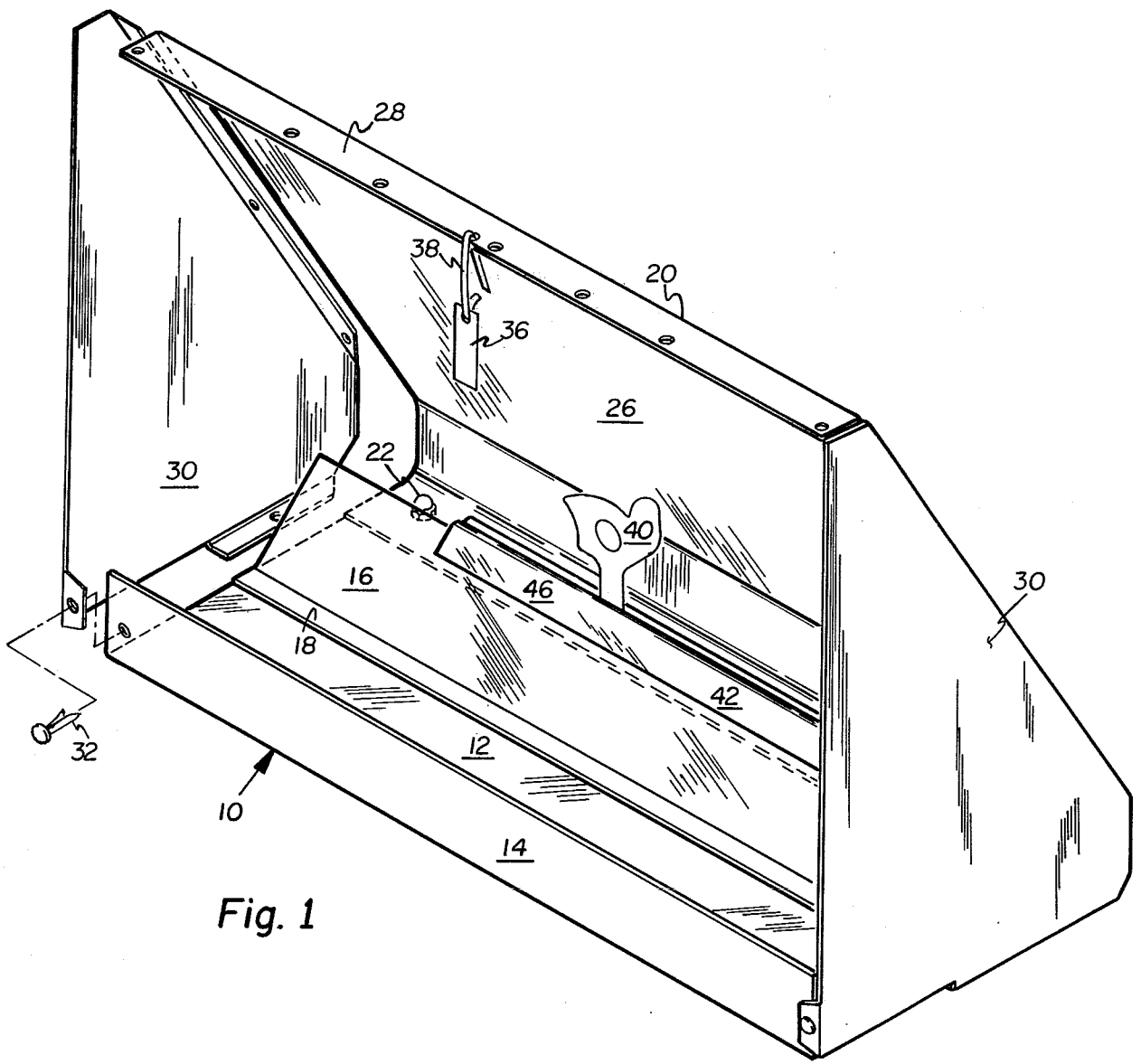

FIGS. 1 and 2 show a range 10, in accordance with the invention, having a base 12 with a lip 14. Mounted, preferably by welding, to base 12 is a target support ramp 16. Ramp base 18 is the portion of ramp 16 affixed to base 12.

A backstop 20 is attached to base 12, preferably by detachable means such as bolts 22 and nuts 24. Two or more sets of bolts and nuts may be used. Backstop 20 is structured so that its pellet impact area 26 is up to 65° from the horizontal, or pellet travel direction. Other equivalent mounting devices or substances may be used to mount backstop 20 to base 12. However, such devices and substances must allow backstop 20 to vibrate in order to absorb kinetic pellet energy. This energy dissipation by vibration is a novel and important feature of the instant invention. The two-bolt securing of the backstop to the base of the preferred embodiment has functioned very well, allowing sufficient vibration for the range to take at least 20,000 shots into a small area without visible sign of denting or wear.

For the sake of clarity, in this description it will be assumed that pellets travel horizontally and that the range sits on a horizontal surface. Naturally, pellet travel direction and the range may be oriented as a user desires. However, pellets should be fired essentially parallel to base 20 to strike the range area 26 of range backstop 20 as it is designed to be struck.

Backstop 20, in this preferred embodiment, comprises 16 gauge cold, rolled steel, commercial temper, approaching one quarter hardness. However, those skilled in the art will appreciate that other steels of other thicknesses and hardnesses will perform as well if they vibrate so as to dissipate the impact or kinetic energy of striking pellets. This energy dissipating vibration is an essential and novel feature of the invention. It allows for thinner steels to be used as backstops. It also provides backstop to pellet direction angles of up to about 65°. Prior art ranges are typically limited to 45° backstop to pellet direction angles in order to offer reasonable lifetimes because their backstops must absorb without moving essentially all of the kinetic energy of impacting pellets. The metal in such prior art backstops must also be thicker, as well as positioned at a less than 45° angle to impacting pellets in order to provide a reasonable useful life.

In practicing the invention, the vibratorily resilient nature of backstop 20 must be preserved. Therefore, novel resilient sidewalls 30 are provided. Sidewalls 30 preferably comprise as thin as 22 gauge steel. Sidewalls 30 may comprise other suitable materials, such as polyethylene, which are well known to those skilled in the art. For example, polyethylene sidewalls are preferably 0.026 to 0.030 inch thick. Sidewalls 30 fasten to base 12, and its lip 14 as well as backstop 20 with, for example, brads 32 which pass through appropriate apertures. Brads provide a somewhat loose attachment which aids in allowing backstop 20 to freely vibrate. However, those skilled in the art will appreciate that equivalent fasteners can be utilized.

Targets 36 may be suspended from apertures in a top lip 28 on backstop 20 by tapes 38. Knockdown and return targets 40 may sit atop ramp 16 on a V channel support 42 so that as pellets strike target 40, their momentum causes it and support 42 to tip toward backstop 20. Target 40 and support 42 then return to their initial positions because front portion 46 of support 42 is heavier than its rear portion 48.

The various features and advantages of the invention are thought to be clear from the foregoing description. However, various other features and advantages not specifically enumerated will undoubtedly occur to those versed in the art, as likewise will many variations and modifications of the embodiment illustrated herein, all of which may be achieved without departing from the spirit and scope of the invention as defined by the appended claims.

I claim:

1. A range for receiving lead bullets from gas, spring and air powered guns at up to 800 feet per second, weighing up to 16 grains and of up to 0.22 calibre, comprising:

a base;

a resilient steel backstop extending from said base for receiving said pellets fired into said range;

means for mounting the bottom of said backstop in cantilevered fashion to the base;

said backstop being sufficiently thin to be damaged by said pellets if rigidly held; and said mounting means and the thickness of the backstop combining to dissipate essentially all of the kinetic energy of fired pellets by allowing the backstop to vibrate relative to the base.

2. The invention of claim 1 further comprising sidewalls attached to said base and said backstop, said sidewalls being sufficiently resilient and so mounted as to allow said backstop to vibrate when struck by a pellet.

3. The invention of claim 2 wherein said backstop comprises cold, rolled steel as thin as 16 gauge and approaching one quarter hardness.

4. The invention of claim 3 wherein said sidewalls comprise steel as thin as 22 gauge.

5. The invention of claim 3 wherein said sidewalls comprise polyethylene from about 0.026 to about 0.030 inch thick.

6. The invention of claim 1 wherein said backstop meets said horizontal base at an angle to pellet travel of from about 59° to about 65°.

* * * * *